United States Patent [19]

Odenath

[11] Patent Number: 4,466,593

[45] Date of Patent: Aug. 21, 1984

[54] COPYHOLDER, LECTERN, BOOK SUPPORT

[76] Inventor: Clayton P. Odenath, 108 Peach Rd., Bellmawr, N.J. 08031

[21] Appl. No.: 239,349

[22] Filed: Mar. 2, 1981

[51] Int. Cl.[3] ..... A47G 1/24

[52] U.S. Cl. ..... 248/455; 248/460

[58] Field of Search ..... 108/1, 11, 12; 248/148, 248/149, 188.2, 188.8, 351, 455, 456, 460, 558

[56] References Cited

U.S. PATENT DOCUMENTS

| | | | |
|---|---|---|---|
| Re. 12,721 | 11/1907 | Englefield | 248/455 |
| 1,308,010 | 6/1919 | Gibson | 248/460 |
| 2,054,098 | 9/1936 | Rich | 108/12 |
| 2,481,724 | 9/1949 | Croteau | 108/1 X |
| 3,282,437 | 11/1966 | Hansen | 248/460 X |
| 3,999,734 | 12/1976 | Gibson | 248/460 |
| 4,111,390 | 9/1978 | St. Jean | 248/274 |
| 4,343,450 | 8/1982 | Anderson | 248/460 X |

*Primary Examiner*—William H. Schultz

[57] ABSTRACT

The invention is a multipurpose device made of a clear transparent material which blends in with any decor. Its unique appearance makes it inconspicuous and allows for an unobstructed view when not in use. It is collapsible, portable and can be used as a copyholder, lectern or book support capable of holding books and copies of various size and nature such as dictionaries, bibles, notebooks, mechanical drawings, musical compositions, office dictation and the like.

The device consists of a back support member with a clip mounted at the top front of the same, a ledge mounted near the bottom front of said back support member, two rails which parallel each other mounted in a vertical position on the back of said support member and two quadrilateral legs which slide into said rails in six different ways to form different adjustable positions, the lectern being one of said positions.

4 Claims, 14 Drawing Figures

COPYHOLDER, LECTERN, BOOK SUPPORT

BACKGROUND AND SUMMARY OF THE INVENTION

The invention relates to a book and copyholding device which can be converted into a lectern. Originally invented to hold a student's musical studies and works, the multipurpose device made of a clear temperature material is unique and modern in appearance, blends in with any decor and allows for an unobstructed view when not in use. It is a new and different alternative to the present day state of the art. Modern and unique in appearance, versatile and low in cost, it attracts a variety of people in various professions and occupations such as students, teachers, engineers, technicians, executives, secretaries, lecturers, doctors, lawyers, artists, salesmen and the like. Collapsible and portable, it can be taken apart for storage when not in use. Strong, yet light in weight, it is capable of holding books and copies of various size and nature such as dictionaries, bibles, notebooks, mechanical drawings, diagrams, musical compositions, office dictation and the like.

The device consists of a rectangular back support member with a clip at the top front of the same, a ledge mounted near the bottom front of said back support member, two rails which parallel each other, mounted in a vertical position on the back of said support member, two quadrilateral legs which insert into said rails, in six different ways to form different adjustable positions and two rectangular feet which mount onto said legs for purposes of balancing and stabilization when said device is in the lectern position or any other position where needed.

The leg and rail combination makes it possible to achieve a number of various positions from a 90° angle to a 30° angle and every angle in between simply by inserting the quadrilateral legs in the rails in any one of their various positions and then sliding said rails upwardly or downwardly to achieve the exact degree of angle or position desired.

Figure 3:
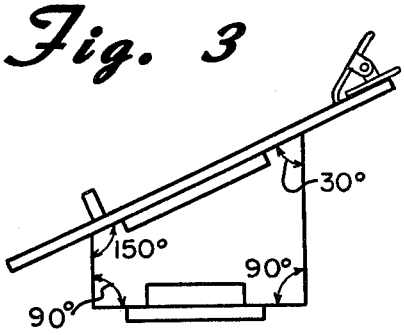
Figure 5:
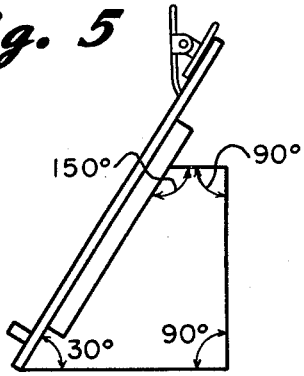

FIGS. *2a*, *2b* and *2c* are side views showing the device in a 90°, 80° and 70° position, respectively;

FIG. 3 is a side view of the device in the 30° angle lectern position;

FIGS. *4a*, *4b*, *4c* and *4d* are side views showing the device in two different 60° positions and a 50° and 40° position, respectively;

FIG. 5 is a variation of FIG. *4a;*

Figure 6:
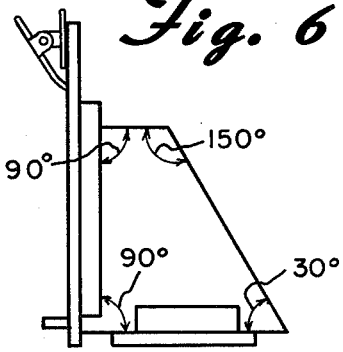

FIG. 6 is a variation of FIG. *2a;*

Figure 7:
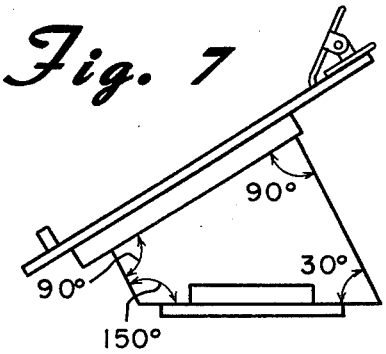
Figure 8:
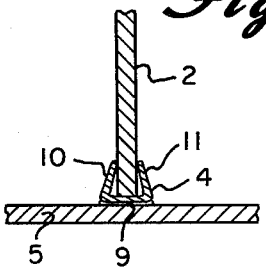
Figure 9:
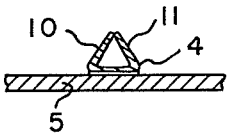

FIG. 7 is a variation of FIG. 3;

FIG. 8 is a cross-sectional view illustrating the manner in which the legs are held by the rails, and FIG. 9 is a view similar to FIG. 8 showing a rail without a leg inserted therein.

DESCRIPTION OF SPECIFIC EMBODIMENTS

Figure 1:
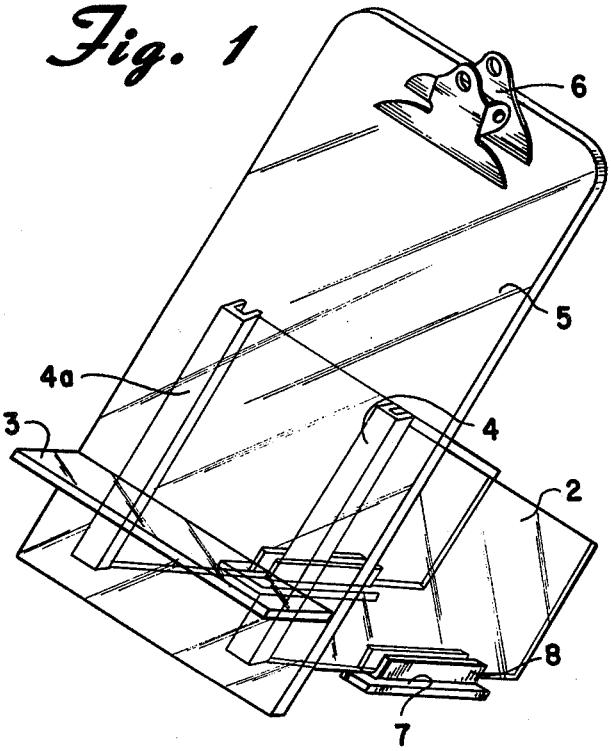
FIG. 1 is a perspective view of the copyholder, lectern, book support in the 60° angle position.

More specifically, referring to the drawing, the copyholder, lectern and book support device generally designated FIG. 1 includes a back support member 5 with a clip 6 mounted on the top front of 5 affixed to 5 by means of two rivets. A ledge 3 is mounted onto member 5 in a horizontal position, being perpendicular to said back support member 5 and affixed to said back support member by means of adhesive. Two rails 4 and 4*a* mounted in a vertical position on back of 5, running parallel with each other, are affixed to said back support member 5 by means of adhesive. Two quadrilateral legs 2 and 2*a* of non-isosceles trapezoidal configuration are inserted into rails 4 and 4*a* and are adjustable by sliding them upwardly or downwardly within said rails 4 and 4*a* and act as the support for said back support member 5. Two identical rectangular feet 7 having rails 8 mounted thereon slide onto the base of said legs 2 and 2*a* reinforcing the balancing stabilization of said device in any position and are attachable and detachable and slide forward or backward for adjustment purposes. As shown in the figures, each foot 7 has a major dimension which is parallel to the leg to which it is attached and a minor dimension perpendicular to said leg.

Figure 2A:
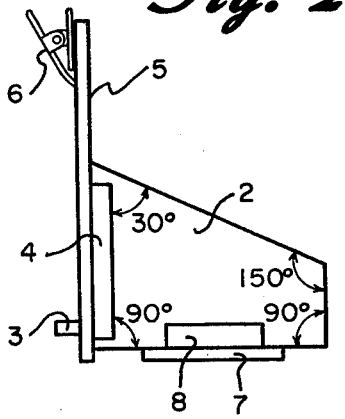
Figure 2B:
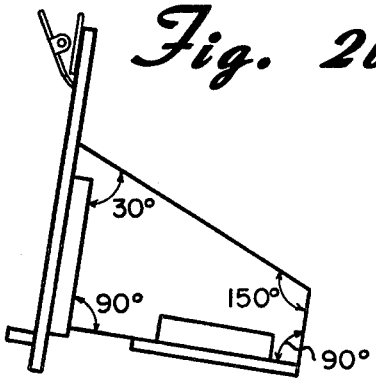
Figure 2C:
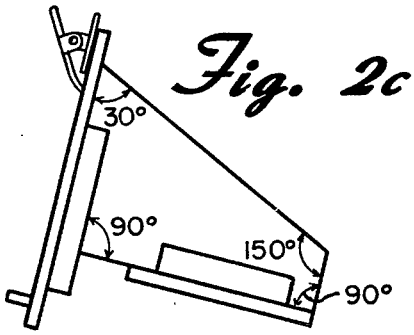

FIG. 2 shows a side view of the device in the 90° position which is achieved by inserting said legs 2 and 2*a* into said rails 4 and 4*a* so that the two 90° angles of legs 2 and 2*a* are adjacent to each other forming the base with back support member 5 being mounted on the side of leg 2 where the 150° angle and the 90° angle join. The foot 7 is attached in this position but is optional.

Figure 4A:
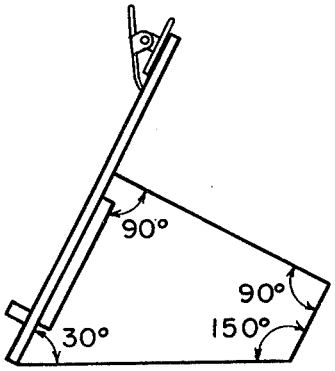
Figure 4B:
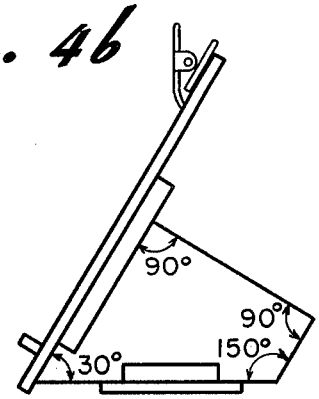
Figure 4C:
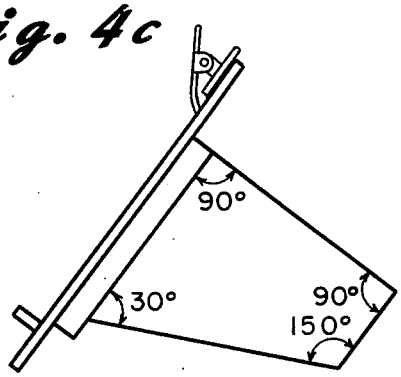
Figure 4D:
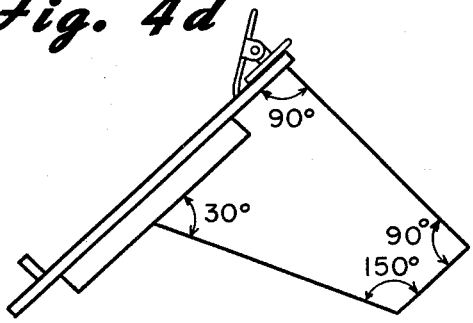

FIG. 3 shows the device in the lectern 30° position and is achieved by mounting back support member 5 onto the side of leg 2 where the 30° angle and 150° angle join. The two 90° angles of leg 2 form the base with the foot 7 attached to leg 2. FIG. 4*a* shows a side view of the device in the 60° position with foot 7 detached. This position is achieved by inserting leg 2 into rail 4 so that back support member 5 rests against the side of leg 2 where the 90° angle and 150° angle join. The base being formed by the 150° angle and 30° angle.

FIGS. *2a*, *2b* and *2c* show the device as it goes from a 90° angle position by sliding the leg 2 upwardly within the rail 4*a*. Starting at the 90° position you can achieve any angle between 90° and 60° simply by stopping the ascension of the leg 2 at any point of angle desired (FIG. *2b* shows the device stopped at the 80° angle position.)

FIGS. *4a*, *4b*, *4c* and *4d* show the device as it goes from a 60° angle position to a 40° angle position again by sliding the leg 2 upwardly within the rail 4*a*. Starting at the 60° position you can achieve any angle between 60° and 30° simply by stopping the leg 2 at any point of angle desired. (FIG. *4c* shows the device stopped at the 50° angle position.)

FIG. 5 shows how the leg 2 can be manipulated and inserted into the rail so as to form another variation of the 60° angle position. In FIG. *4b*, the back support member 5 rests against the part of the leg where the 150° and 90° angles join. In FIG. 5, the back support member 5 rests against the part of the leg where the 150° and 30° angle join and having the base formed by the 150° and 90° angles.

FIG. 6 shows how the manipulation of the leg 2 can form another variation of the 90° angle position. In FIG. *2a*, the back support member 5 rests against the part of the leg where the 90° and 150° angles join. In FIG. 6, the back support member 5 rests against the part of the leg where the two 90° angles join and having the base formed by the 90° and 150° angles.

Referring now to FIGS. 8 and 9, it can be seen that each rail 4 and 4*a* has a base 9 and sides 10 and 11 which rise upwardly from the base substantially parallel to each other but substantially perpendicular to the base.

As shown most clearly in FIG. 9, when a leg 2 is not inserted therein, the sides 10 and 11 bend or curve symmetrically inward as they ascend and contact each other at their upper ends where they terminate. The sides 10 and 11 thus provide or form a spring-like tension between them at their upper ends to maintain the legs 2 therein as shown in FIG. 8. Although not specifically shown, it will be understood that the rails 8 on the feet 7 are similar to the rails 4 and 4*a* and attach to the legs 2 and 2*a* in a similar manner.

Having described my invention, what is claimed is:

1. A device for use as a copyholder, lectern, book support or the like comprised of a rectangular back support member with a clip for holding documents of various size and nature, said clip being mounted in a horizontal position at the top front of said support member; a ledge for holding books of various size and nature mounted at the bottom front of said support member in a horizontal position, said ledge being perpendicular to said support member; two parallel rails mounted in a vertical position on the back of said support member; two quadrilateral legs of non-isosceles trapezoidal configuration adapted to be inserted into said rails in six different ways to form different adjustable positions, and two rectangular feet having rails affixed thereto and being adapted to be mounted onto said legs, each foot having a major dimension parallel to the leg to which it is attached and a minor dimension perpendicular to said leg thereby providing balancing and stabilization; said back support member, said ledge, said legs and said feet being substantially comprised of transparent material.

2. The device as claimed in claim 1 wherein said rails have a base and sides which rise upwardly from the base parallel to each other and perpendicular to said base, said sides curving symmetrically inward as they ascend making contact at a point and terminating at said point thereby forming a spring-like tension between said sides at their point of termination.

3. The device as claimed in claim 1 wherein each of said legs is formed so as to have four interior angles consisting of two 90° angles which are adjacent to and connect with each other forming three sides of each leg, and a 150° angle and a 30° angle which are adjacent to each other forming the fourth side of each leg.

4. The device as claimed in claim 1 wherein said feet are detachable from and adjustable with respect to said legs.

* * * * *